US005842640A

United States Patent [19]

Ganser

[11] Patent Number: 5,842,640

[45] **Date of Patent: *Dec. 1, 1998**

[54] FUEL INJECTION VALVE FOR INTERNAL COMBUSTION ENGINES

[75] Inventor: Marco A. Ganser, Zurich, Switzerland

[73] Assignee: Ganser-Hydromag, Zurich, Switzerland

[ * ] Notice: The term of this patent shall not extend beyond the expiration date of Pat. No. 5,685,483.

[21] Appl. No.: 915,602

[22] Filed: Aug. 21, 1997

Related U.S. Application Data

[63] Continuation of Ser. No. 462,422, Jun. 5, 1995, Pat. No. 5,685,483.

[30] Foreign Application Priority Data

Jun. 6, 1994 [CH] Switzerland ..... 01782/94

[51] Int. Cl.[6] ..... F02M 47/02

[52] U.S. Cl. ..... 239/89; 239/533.3; 239/533.9; 137/624.13

[58] Field of Search ..... 289/88–92, 533.1, 289/533.3, 533.9; 123/506; 137/624.13

[56] References Cited

U.S. PATENT DOCUMENTS 4,870,943 10/1989 Bradley .
5,094,397 3/1992 Peters et al. .
5,423,484 6/1995 Zuo .
5,464,156 11/1995 Ricco et al. .

FOREIGN PATENT DOCUMENTS 0 089 301 3/1983 European Pat. Off. .
0 228 578 11/1986 European Pat. Off. .
0 426 205 11/1986 European Pat. Off. .
0 548 916 12/1992 European Pat. Off. .
0 548 916 6/1993 European Pat. Off. .

*Primary Examiner*—Andres Kashnikow
*Assistant Examiner*—Lisa Ann Douglas
*Attorney, Agent, or Firm*—McDermott, Will & Emery

[57] ABSTRACT

The opening and closing motion of a control piston effectively connected to an injection valve element is optimally designed in that in addition to a first control space, there is a second control space whose volume and fuel control pressure can be changed by the piston motion. During the opening motion, the pressure in the second control space retards the opening procedure. During the closing motion, the control piston is additionally accelerated by the system pressure when there is a predetermined pressure in the second control space in order to effect rapid closing of the injection openings. Relief elements ensure a pressure balance between the second control space and the high-pressure region. One of the two control spaces is connected to the high-pressure region when there is a predetermined pressure in the second control space.

6 Claims, 12 Drawing Sheets

FUEL INJECTION VALVE FOR INTERNAL COMBUSTION ENGINES

This application is a continuation of application Ser. No. 08/462,422 filed Jun. 5, 1995 now U.S. Pat. No. 5,685,483.

FIELD OF THE INVENTION

The invention relates to a fuel injection valve for intermittent fuel injection into the combustion space of an internal combustion engine.

BACKGROUND OF THE RELATED ART

Known injection valves of this type, for example are described in European Patents Nos. EP0228578 and EP0426205.

The invention achieves the object of creating a fuel injection valve which ensures improved operating behavior and is, in addition, extremely simple with respect to manufacture and assembly.

The invention is described in more detail below by using the embodiment examples shown in the drawing.

DETAILED DESCRIPTION OF THE PREFERRED EMBODIMENTS

Figure 1:
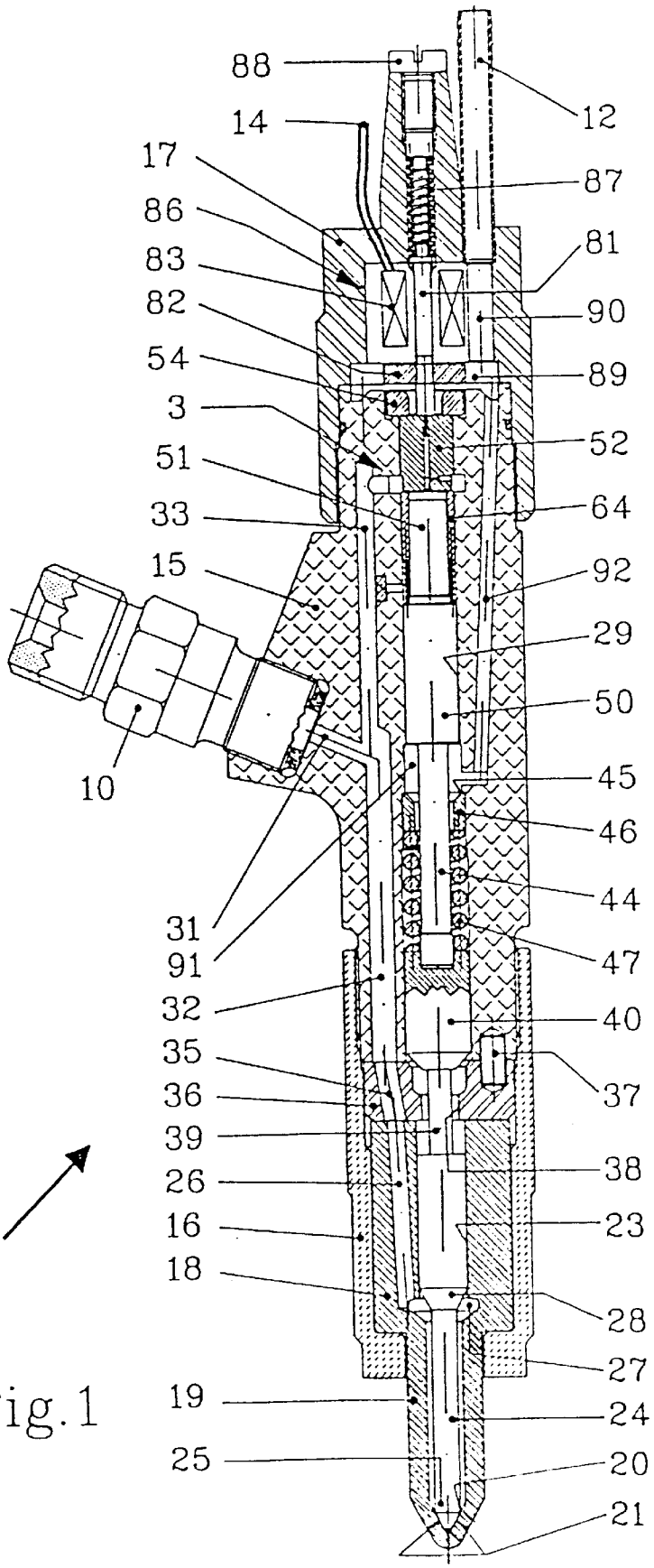
FIG. 1 shows a first design of a fuel injection valve in longitudinal section.

In FIG. 1, a fuel injection valve 1 is depicted in a position between two injection procedures. The fuel injection valve 1 is connected to a high-pressure delivery device for the fuel by means of a fuel high pressure connection 10 and by means of a fuel return connection 12 and is connected to an electronic control system by means of electrical connections 14. The high-pressure delivery device and the electronic control system are not depicted in the drawing.

The housing of the fuel injection valve 1 is designated by 15. At its lower end, the housing 15 is tightly screwed into a retention part 16 configured as a union nut and, at its upper end, it is firmly screwed into a corresponding retention nut 17.

A nozzle body 18 is inserted in the retention part 16 so that a nozzle tip 19 protrudes from the retention part 16. The nozzle tip 19 is provided with a nozzle needle seat 20 and has a plurality of injection openings 21 in this region. In the nozzle body 18, an axially adjustable nozzle needle 24, which forms an injection valve element, is guided so that it can slide in a needle guide hole 23. The injection openings 21 of the nozzle tip 19 can be closed by a lower end 25 of the nozzle needle 24.

The housing 15 is provided with a central guide hole 29 in which is arranged a control appliance 3 for controlling the adjustment motion of the injection valve element or nozzle needle 24. The control appliance 3 is comprehensively described further below with reference to FIG. 2.

The fuel is delivered by the high-pressure delivery device via the high-pressure fuel connection and a first short fuel supply hole 31 into two high-pressure supply conduits 32, 33 arranged, parallel to the guide hole 29, in the housing 15. The upper high-pressure supply conduit 33 leads to the control appliance 3. The lower high-pressure supply conduit 32 is connected, by means of a connecting hole 35 obliquely arranged in an intermediate plate 36, to a nozzle body hole 26, which opens into an annular space 27 in the nozzle body 18. From the annular space 27, the fuel reaches the nozzle needle seat 20 and the injection openings 21 via passages which are not represented in any more detail. The nozzle needle 24 is provided with a shoulder 28 in the region of the annular space 27.

The intermediate plate 36 is positioned relative to the housing 15 by means of a pin 37 and is arranged to seal between the housing 15 and the nozzle body 18. Alternatively, two pins 37 may be provided. An upper part 39 of the nozzle needle 24 which protrudes into a central hole 38 of the intermediate plate 36 is effectively connected to a needle intermediate element 40 which is connected, at the other end, via a connecting rod 44 to a control piston 50 of the control appliance 3. A nozzle needle spring 47 surrounding the connecting rod 44 is arranged, so that it is preloaded, between the needle intermediate element 40 and a spring clamping disc 46, which is supported on a shoulder 45 of the housing 15.

The control appliance 3 has a control body 52 which is inserted in a fixed location in the guide hole 29. The control piston 50 is provided with an upper, reduced diameter piston part 51. As may be seen, particularly from FIG. 2, the upper piston part 51 protrudes into a sleeve 64 arranged so that it can be displaced axially and slide with a close fit in the guide hole 29. Narrow slide fits are also provided between the piston part 51 and the internal diameter of the sleeve 64. A spring 63 is arranged between a lower end surface 65 of the sleeve 64 and a piston shoulder surface 53. The sleeve 64 is supported by means of a narrow annular sealing surface 66 on a lower end surface 55 of the control body 52 which, at its other end, is axially fixed in the guide hole 29 by a lock nut 54 screwed into the housing 15.

In the lower region of the control body 52, there is an annular space 69 in the housing 15. This annular space 59 is connected to the upper high-pressure supply conduit 33 by means of a transverse hole 68. The control body 52 has a peripheral annular groove 67 corresponding to the annular space 69. The control body 52 is, furthermore, provided with a connecting hole 60 opening into a first control space 70. This connecting hole 60 is connected via an inlet throttle hole 58 to the peripheral annular groove 67 and to the annular space 69 and also, therefore, to the high-pressure supply conduit 33. At the top, the connecting hole 60 contracts into an outlet opening 59.

The first control space 70 is bounded radially by the internal surface of the sleeve 64 and is bounded axially by the lower end surface 55 of the control body 52 and an upper end surface 56 of the piston part 51.

There is an annular, second control space 74 under the sleeve 64 between the piston part 51 and the guide hole 29. The spring 63 is also arranged in this control space 74 which is connected to the high-pressure supply conduit 33 by means of a connecting hole 75. An orifice plate 76 with a throttle 77 is inserted in the connecting hole 75.

The control body 52 is installed in the guide hole 29 of the housing 15 in such a way that no appreciable leakage can take place. This is, for example, achieved by means of a press fit or a close sliding fit but could also, however, be realized by different fuel-tight connections, for example by the use of suitable sealing rings.

Figure 2:
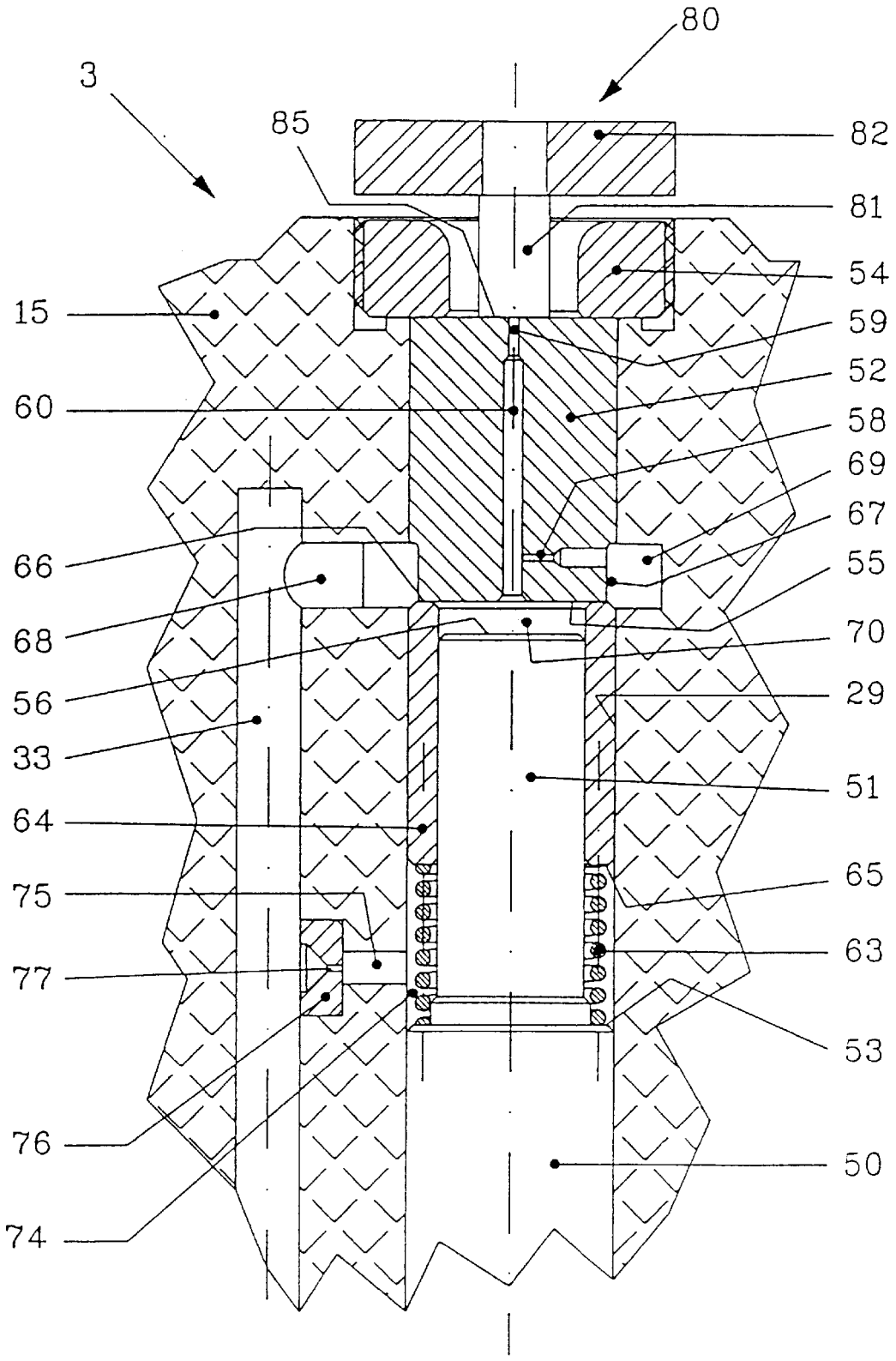
FIG. 2 shows, to an enlarged scale and in longitudinal section, a first embodiment corresponding to FIG. 1 of a control appliance for the fuel injection valve.

The control appliance 3 has, furthermore, an electromagnetically actuated pilot valve 80, of which only an armature 82 firmly connected to a pilot valve stem 81 is visible in FIG. 2. In the position represented in FIG. 2, the outlet throttle hole 59 is held in the closed position by means of a valve flat seating 85. In the currentless condition of an electromagnet 86, the pilot valve stem 81 is pressed downward by the force of a compression spring 87 into the position which closes the valve flat seating 85, as may be seen from FIG. 1. The magnitude of this force can be set by means of an adjusting screw. 88. In order to actuate the pilot valve 80 or to raise the pilot valve stem 81 from the valve flat seating 85, an exciter coil 83 of the electromagnet 86, which exciter coil 83 is associated with the armature 82, receives control pulses from the electronic control system via the electrical connections 14.

As shown in FIG. 1, the fuel emerging from the outlet opening 59 when the pilot valve stem 81 is raised is collected in a drain space 89 and is supplied, via a drain hole 90, to the fuel return connection 12 which, together with the electromagnet 86, is installed in the retention nut 17. The leakage fuel collected in a space 91 below the control piston 50 also flows into the drain space 89 via a relief hole 92. In consequence, part of the fuel is supplied practically unpressurized to the high-pressure delivery device. The space 91, the relief hole 92, the drain space 89 and the drain hole 90 form a so-called low-pressure part of the fuel injection valve 1.

The construction described results in the following mode of operation of the fuel injection valve 1:

Before the injection procedure, the same high pressure or injection pressure, which can be more than 1000 bar, is present in the high-pressure part of the fuel injection valve 1, i.e. in the fuel supply hole 31, in both high-pressure supply conduits 32, 33, in the annular spaces 27, 69 and in both control spaces 70, 74.

As soon as the electronic control system supplies a pulse of selected duration to the electromagnet 86, the latter attracts the armature 82 against the force of the spring 87 with the result that the pilot valve 80 is opened. The outlet opening 59 of the control body 52 is therefore opened. The pressure in the first control space 70 drops. The nozzle needle 24 is raised from the nozzle needle seat 20 by the fuel pressure present in the annular space 27 and acting on the shoulder 28. The injection openings 21 are freed and the fuel is injected, in a manner known per se, into the combustion space of the internal combustion engine.

When the nozzle needle 24 is raised, the control piston 50 is also moved upward by means of the needle intermediate element 40 and the connecting rod 44. The volume of the second control space 74 becomes smaller and the pressure in the control space 74 increases due to this pumping effect. The sleeve 64 is pressed even more strongly into the position sealing against the control body 52. The pressure in the second control space 74, which acts against the opening motion of the injection valve element and the nozzle needle 24, is defined in a desired, controlled manner by means of the connecting hole 75 and the throttle 77, which lead to the high-pressure supply conduit 33. This achieves the objective of a controlled opening of the injection valve.

The injection procedure should, as is known, be terminated as rapidly as possible. The pilot valve 80 is brought into its closed position by means of the electromagnet 86, again under electronic control. Because the outlet opening 59 is now closed again, the pressure increases in the first control space 70 and the control piston 50 is moved downward by the force acting on the upper end surface 56 of the piston part 51. The volume of the second control space 74 is increased and the fuel pressure in the second control space 74 drops. The sleeve 64 initially remains pressed onto the control body 52. When the fuel pressure in the second control space 74 has dropped by a certain amount, the sleeve 64 follows the motion of the piston. Because the spring 63 is relatively weakly preloaded, the pressure effect of the spring 63 is negligible in comparison with the fuel pressure forces. As soon as the sealing surface 66 of the sleeve 64 rises from the control body 52, this new connection causes an abrupt passage of fuel from the annular space 69 and out of the high-pressure supply conduit 33 into the first control space 70. The control piston 50 and, in addition, the sleeve 64 are accelerated downward; the nozzle needle 24 is pressed into the position closing the injection openings 21 by means of the connecting rod 44 and the needle intermediate element 40. This realizes a rapid injection closing procedure in the fuel injection valve 1 according to the invention.

As soon as the pressure in the second control space 74 is brought into balance with the high fuel pressure of the system by means of the throttle 77 and the connecting hole 75, the spring 63 presses the sleeve 64 with the sealing surface 66 into the position which radially bounds the first control space 70.

In a first alternative variant (not represented in the drawing) of the control appliance 3 of FIG. 2, a contraction configured as a throttle is introduced either into the transverse hole 68 or into the upper high-pressure supply conduit 33. This contraction causes a weak throttling action and therefore slightly damps the acceleration of the control piston 50 during the closing procedure. This reduces the impact of the nozzle needle 24 on the nozzle needle seat 20 at the end of the closing procedure. If the contraction is provided in the upper high-pressure supply conduit 33, it can be located either in the region below the throttle 77 or in the region above it. This first variant of the control appliance 3 is then particularly to be preferred where (for design reasons) there is danger that the nozzle needle seat 20 could be damaged by an excessive impact of the nozzle needle 24.

In a second alternative variant (likewise not represented in the drawing) of the control appliance 3, the throttle 77 is made large or is dispensed with completely, so that the connecting hole 75 is directly connected to the upper high-pressure supply conduit 33. In this variant the high fuel pressure of the system is, in consequence, always present in the second control space 74 and, due to the pumping effect of the control piston 50, this high pressure hardly increases or does not increase at all during the opening motion of the nozzle needle 24; the pressure in the second control space 74 does not drop during the closing procedure either. In this case, the sleeve 64 does not lose contact with the lower end surface 55 of the control body 52 during the closing motion of the nozzle needle 24. This is ensured by appropriate dimensioning of the spring 63. The advantage of this variant lies in the smaller control surface, relative to known solutions, which has to be controlled by the two throttle holes 59 and 58. The motion of the substantially larger control piston 50 is controlled by means of the control surface corresponding to the end surface 56 of the upper piston part 51.

Figure 3:
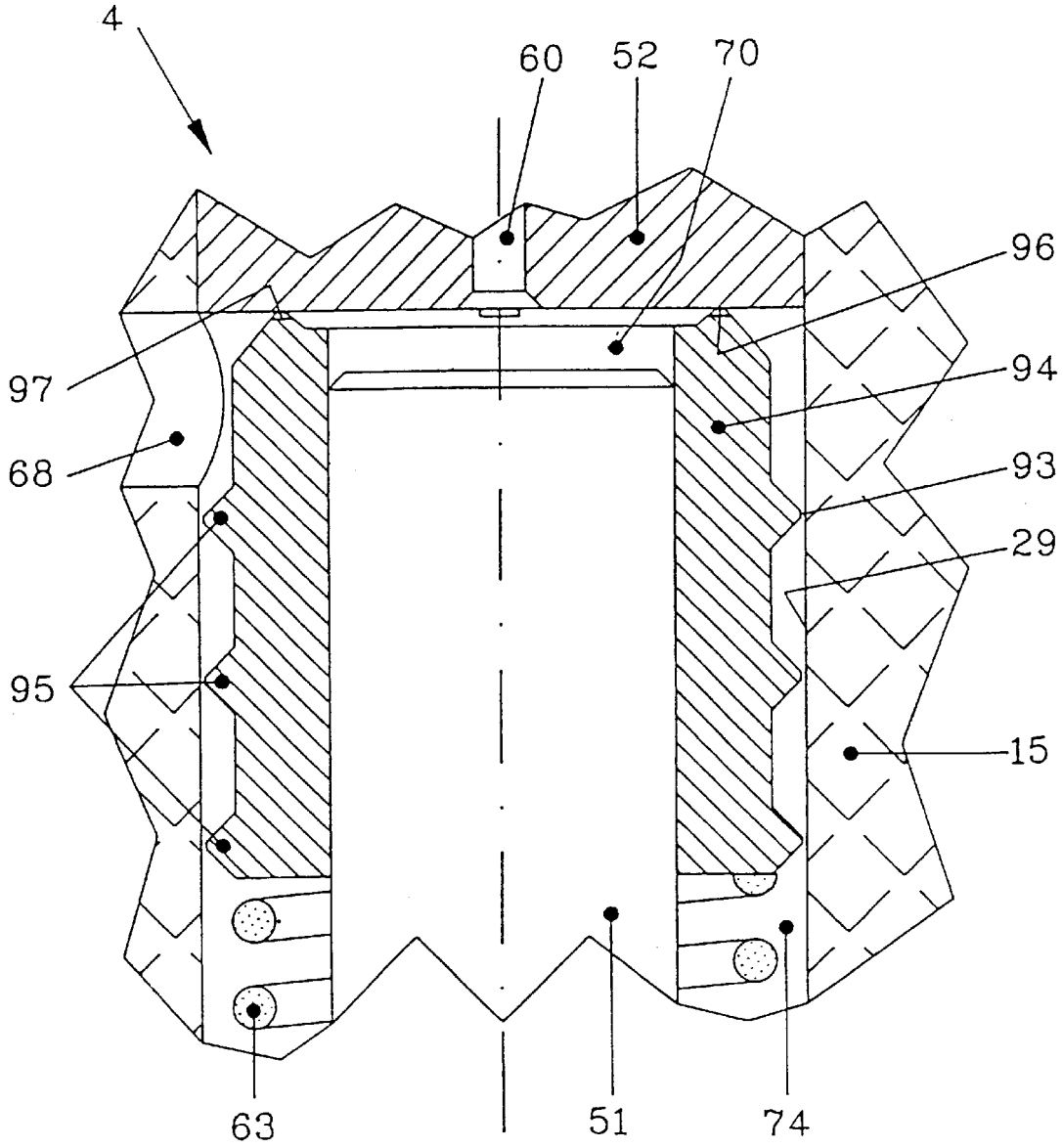
FIG. 3 shows a second embodiment of the control appliance.
Figure 4:
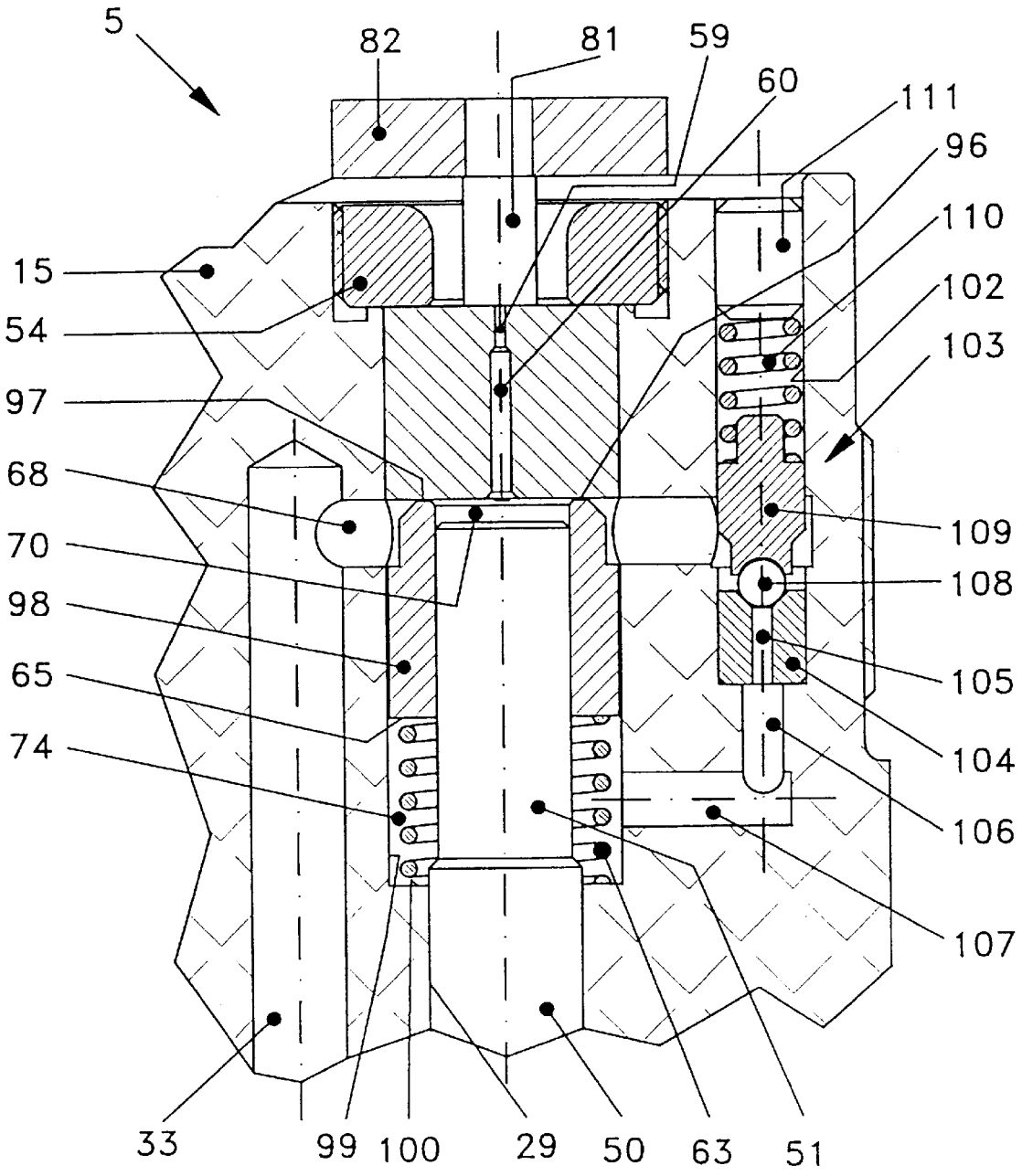
FIG. 4 shows a third embodiment of the control appliance.
Figure 5:
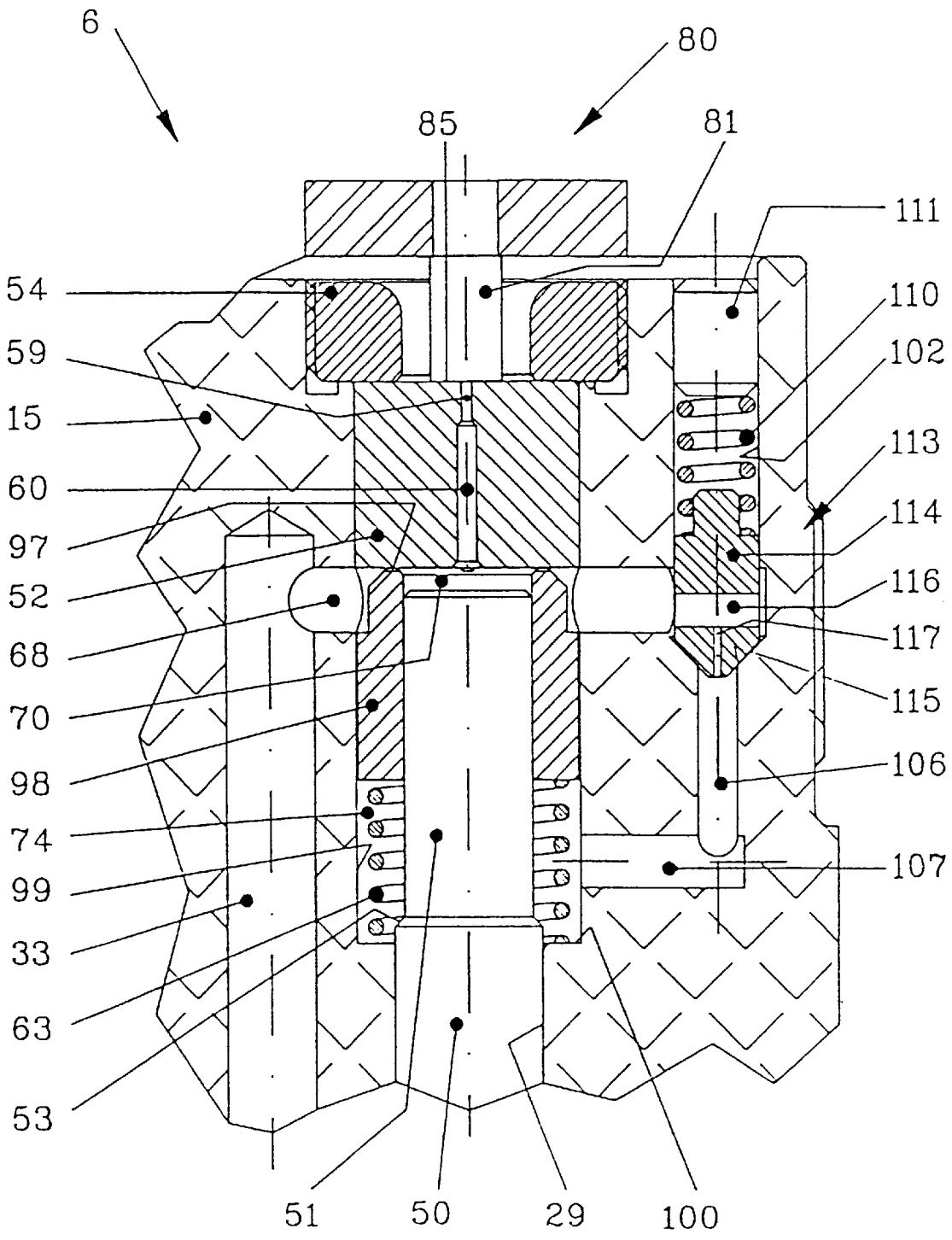
FIG. 5 shows a fourth embodiment of the control appliance.

Further embodiments of the control appliance for the fuel injection valve are represented in FIGS. 3, 4 and 5 and are described in more detail below. The parts which are known from FIGS. 1 and 2 and which act in the same manner continue to be designated by the same reference numbers.

In the embodiment of a control appliance 4 represented in FIG. 3, the sleeve 64 known from FIGS. 1 and 2 is replaced by a sleeve 94. At its periphery, the sleeve 94 has a plurality of ribs 95 which are arranged in series in the axial direction. The external diameter of these ribs forms an exactly defined radial annular gap 93 relative to the guide hole 29. The annular groove 67 in the control body 52 and the annular space 69 in the housing 15 are omitted. The transverse hole 68 supplying the high-pressure fuel opens into the guide hole 29 above the uppermost rib 95. The sleeve 94 is provided with a narrow, annular sealing surface 96 on its upper end surface. The sealing surface 96 has a plurality of radial depressions 97 of small depth (approximately 0.02–0.03 mm) distributed around its periphery. By means of these depressions 97, the fuel is throttled as it passes from the guide hole 29, and in consequence from the transverse hole 68, to the first control space 70. The depressions 97 replace the inlet throttle hole 58 of the control appliance 3 known from FIG. 2. The ribs 95, on the other hand, replace the throttle 77 (known from FIG. 2) installed between the second control space 74 and the high-pressure supply conduit 33. The ribs 95 have sharp edges so as to achieve turbulent flow whatever the viscosity of the fuel. The arrangement of a plurality of ribs 95 in series causes the fuel pressure to decrease in steps and reduces the flow velocity. In consequence, the annular gap can be more generously dimensioned.

The position of the sealing surface 96 relative to the external and internal diameters of the sleeve 94 can be selected as a function of the contact pressure force necessary. The same sealing surface 96 and/or the radial depressions 97 could also be used in the case of the sleeve 64 of FIG. 2.

This embodiment of the control appliance 4 is simpler to manufacture than the embodiment represented in FIGS. 1 and 2. Otherwise, the mode of operation is the same as that already described.

In a similar manner to the control appliance 3 of FIG. 2, the control appliance 4 of FIG. 3 can also be configured to correspond with the first and second alternative variants described. In order to realize the second variant, in which the second control space 74 is in direct connection with the high-pressure zone, a wide annular gap 93 can be provided between the sleeve 94 and the guide hole 29, or the ribs 95 can be omitted completely.

A further embodiment of the control appliance is represented in FIG. 4 and is designated by 5.

A sleeve 98, which like the sleeve 94 known from FIG. 3 is equipped with the narrow sealing surface 96 provided with depressions 97, is guided as a close sliding fit in a wider diameter part 99 of the guide hole 29. The spring 63 is preloaded between the lower end surface 65 of the sleeve 98 and a housing shoulder 100.

A ball non-return valve 103 is installed in a housing hole 102 which is manufactured parallel to the guide hole 29 in the housing 15. A lower valve seat element 104 of the ball non-return valve 103 has a hole 105 which is connected to the second control space 74 by means of holes 105u and 107. A ball 108 associated with the valve seat element 104 is pressed onto the valve seat element 104 by the force of a spring 110 by means of a second valve element 109. The ball non-return valve 103 is axially fixed in the housing hole 102 by means of a stopper spigot 111 which can also be used to select the preload on the spring. The connection between the second control space 74 and the high-pressure zone is therefore produced by means of the ball non-return valve 103.

If, during the upward motion of the nozzle needle 24 and the control piston 50, the fuel pressure increases to a certain magnitude due to the pumping effect of the control piston 50, the ball 108 of the ball non-return valve 103 is lifted and the pressure is suddenly brought into balance with the high pressure of the system so that the reaction against the opening motion of the nozzle needle 24 is suddenly cancelled (the throttle 77 of FIG. 2 has effected a continuous pressure balance). By means of the control appliance 5, the opening motion of the nozzle needle 24 is subdivided into a phase with a smaller opening velocity (before the opening of the ball non-return valve 103) and a phase with a larger opening velocity. Such a variation in the opening motion of the nozzle needle 24 effects favorable engine combustion.

A rapid closing motion is achieved in the same manner as in the case of the control appliance 3 because the sleeve 98 frees the connection between the high-pressure system and the first control space 70 during the downward motion of the control piston 50 when the fuel pressure in the second control space 74 drops below a certain magnitude.

A further alternative embodiment of the control appliance is represented in FIG. 5 and is designated by 6. A conical seat valve 113 is installed in the housing hole 102 instead of the ball non-return valve 103 known from FIG. 4. The conical seat between a valve body 114 and the housing 15 is designated by 115. The valve body 114 is provided with a transverse hole 116 and a throttle hole 117 arranged at right angles to the transverse hole 116. The second control space 74 is connected to the high-pressure region by means of the holes 107 and 106, the throttle hole 117 and the transverse hole 116.

In this variant, in the case of an upward motion of the control piston 50, the fuel pressure in the second control space 74 can either be gradually brought into balance by means of the throttle hole 117 when the conical seat valve 113 is closed or it can be brought abruptly into balance with the system pressure, in the case of a large excess pressure, by lifting the valve body 114 from the conical seat 115. In the case of a low system pressure, the conical seat valve 113 does not respond.

Figure 6:
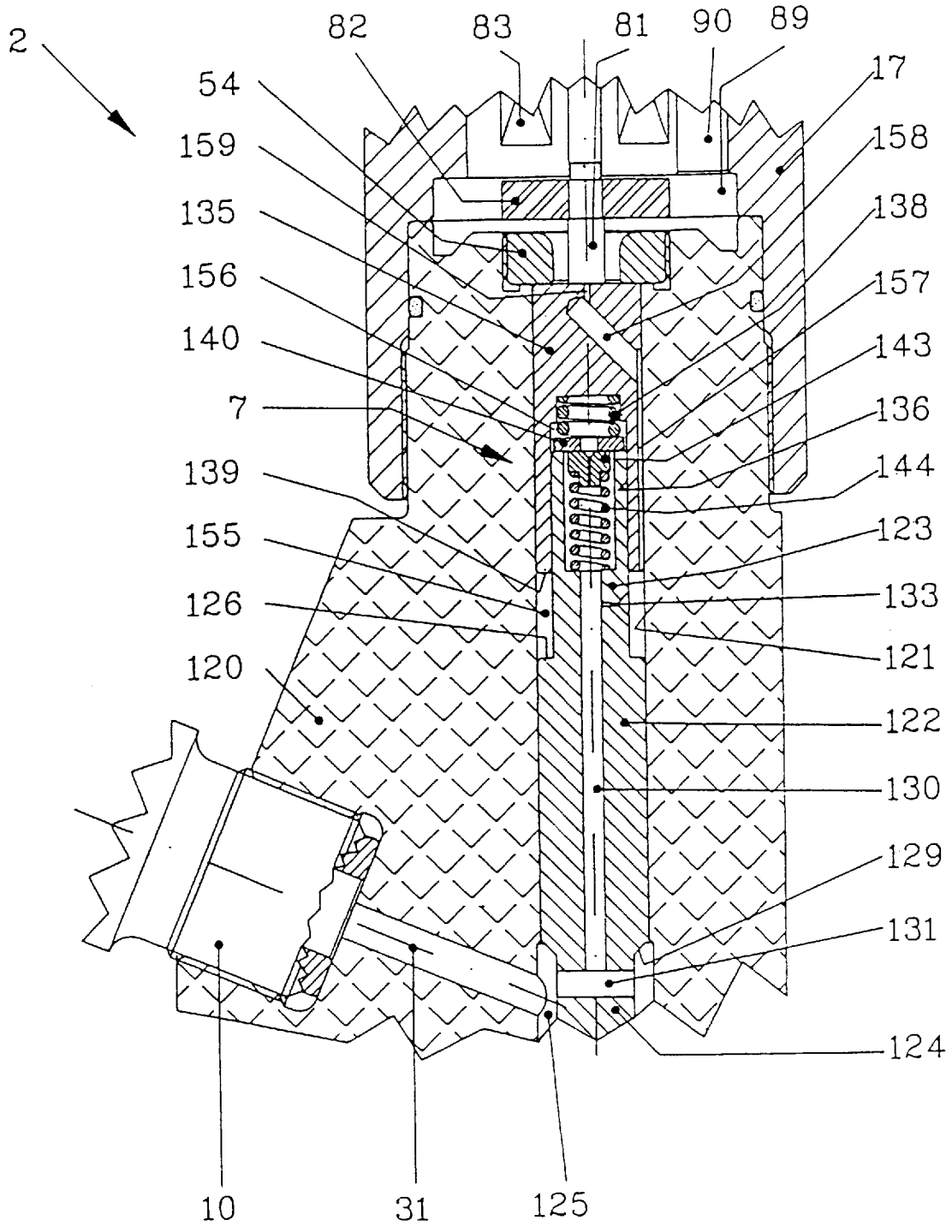
FIG. 6 shows, in partial longitudinal section, a second design of the fuel injection valve with a fifth embodiment of the control appliance.

FIG. 6 shows, in partial section, an alternative design of the fuel injection valve, which is designated by 2 and is equipped with a further control appliance 7. Where they are identical and have the same effects, the parts already known from FIG. 1 to 5 are again designated by the same reference numbers. Part of the control appliance 7 is shown to an enlarged scale in FIG. 7 for better understanding.

As shown in FIG. 6, the fuel injection valve 2 has a housing 120 which is provided with a central guide hole 121 for the control appliance 7. A control piston 122 is arranged in the guide hole 121 so that it is axially displaceable and has a close sliding fit. At the top, the control piston 122 has a reduced diameter piston part 123. The corresponding shoulder surface is designated by 126. At the bottom, the control piston 122 merges into a connecting rod 124 by means of which it is non-positively connected to the injection valve element (nozzle needle), which is not represented in FIG. 6. If appropriate, the connecting rod 124 could even be configured integrally with the injection valve element. A piston shoulder 129 is formed at the transition to the connecting rod 124.

The relatively short, first fuel supply hole 31 from the high-pressure fuel connection 10 opens directly into a space 125 present between the connecting rod 124 and the guide hole 121. The housing 120 itself no longer has further high-pressure supply conduits such as were designated by 32, 33 in the design shown in FIG. 1; no further annular spaces or transverse holes are manufactured in the housing 120 either and this realizes an extremely simple housing 120 with manufacturing advantages.

On its upper end face, the upper piston part 123 is provided with a recess 128 into which opens a central connecting hole 130 manufactured in the control piston 122. The connecting hole 130 is connected to the space 125, which is filled with high-pressure fuel, by means of a transverse hole 131 manufactured in the control piston 122.

A control body 135 is inserted in a fixed location (pressed in, for example) in the guide hole 121 and is axially fixed by the already known lock nut 54. On its lower end face, the control body 135 is equipped with a recess 136 into which the upper piston part 123 protrudes with a close sliding fit. A spring 138, by means of which a valve seat disc 140 is pressed onto the upper annular end surface (designated by 127) of the upper piston part 123, is arranged in a reduced diameter part 137 of the recess 136. The valve seat disc 140 has a central disc hole 141.

A valve body 143, which—in the position represented—closes off the disc hole 141 (with the exception of a throttle hole 142) under the action of a spring 144, is arranged in the recess 128 of the control piston 122.

The valve seat disc 140 and the valve body 143, which closes the disc hole 141, form a first valve flat seating 151. The end surface 127 of the piston part 123 and the valve seat disc 140 form a second valve flat seating 152 (see FIG. 7).

A first control space 155, which is radially bounded by the upper piston part 123, on the one hand, and by the guide hole 121, on the other, is present between an annular, lower end surface 139 of the control body 135 and the shoulder surface 126 of the control piston 122. An inlet throttle 133, which opens radially into the connecting hole 130 and forms a connection between the first control space 155 and the high-pressure fuel zone, is manufactured on the periphery of the upper piston part 123.

At least one connecting groove 157, which connects the first control space 155 to a transverse hole 158 in the control body 135, is manufactured on the periphery of -the control body 135. An outlet opening 159 of the control body 135 opens into the transverse hole 158; in the position represented, this outlet opening 159 is kept closed by the pilot valve stem 81 so that the first control space 155 is separated from the low-pressure part of the fuel injection valve 2.

A second control space 156 is formed above the piston part 123 in the recess 136 of the control body 135 and, in the initial position represented between two injection procedures, is kept separate from the system or high-pressure fuel zone by the two valve flat seatings 151 and 152.

The mode of operation of the fuel injection valve 2 and of the control appliance 7 is as follows:

When the pilot valve stem 81 is raised under electronic control, in the same manner as has already been described at the beginning, the outlet opening 159 is opened. The fuel pressure in the first control space 155 drops. The control piston 122 is moved upward because of the high fuel pressure present in the space 125 and acting on the piston shoulder 129. During this procedure, the injection valve element frees, in the manner already described, the injection openings to the combustion space of the internal combustion engine. When the control piston 122 is lifted, together with the valve seat disc 140, the volume of the second control space 156 is reduced so that the pressure increases during this pumping action and acts in the desired manner against the opening motion. This realizes a slow opening procedure. As soon as the pressure in the second control space 156 has reached a certain level, the valve body 143 is pressed downward against the system pressure present in the recess 128 and against the force of the spring 144 by means of the disc hole 141 and the first valve flat seating 151 is opened so that the opening procedure of the control piston 122, and consequently of the injection valve element, is accelerated.

The outlet opening 159 is closed again by the pilot valve stem so that the pressure in the first control space 155 rises again. The pressure in the second control space 156 is again brought into balance with the system high pressure. The spring 144 presses the valve body 143 onto the valve seat disc 140, which is loaded on the other side by the force of the spring 138. The first valve flat seating 155 becomes closed. The control piston 122 is moved downward by means of the shoulder surface 126. The volume of the second control space 156 is increased and the pressure drops. As soon as the pressure in the second control space 156 is less than a certain value at which no adequate contact pressure force is exerted from above onto the valve seat disc 140, the second valve flat seating 152 is opened. At this moment, a connection is made between the second control space 156 and the high-pressure fuel supply so that the fuel additionally accelerates the control piston 122 downward by means of the end surface 127. A rapid closing procedure of the injection valve element is carried out in this way.

In addition to design and assembly simplification, the fuel injection valve 2 according to the invention also introduces the advantage that minimum leakages occur. The fuel emerging from the outlet throttle hole 159 is again supplied to the fuel return connection by means of the drain hole 90.

Figure 7:
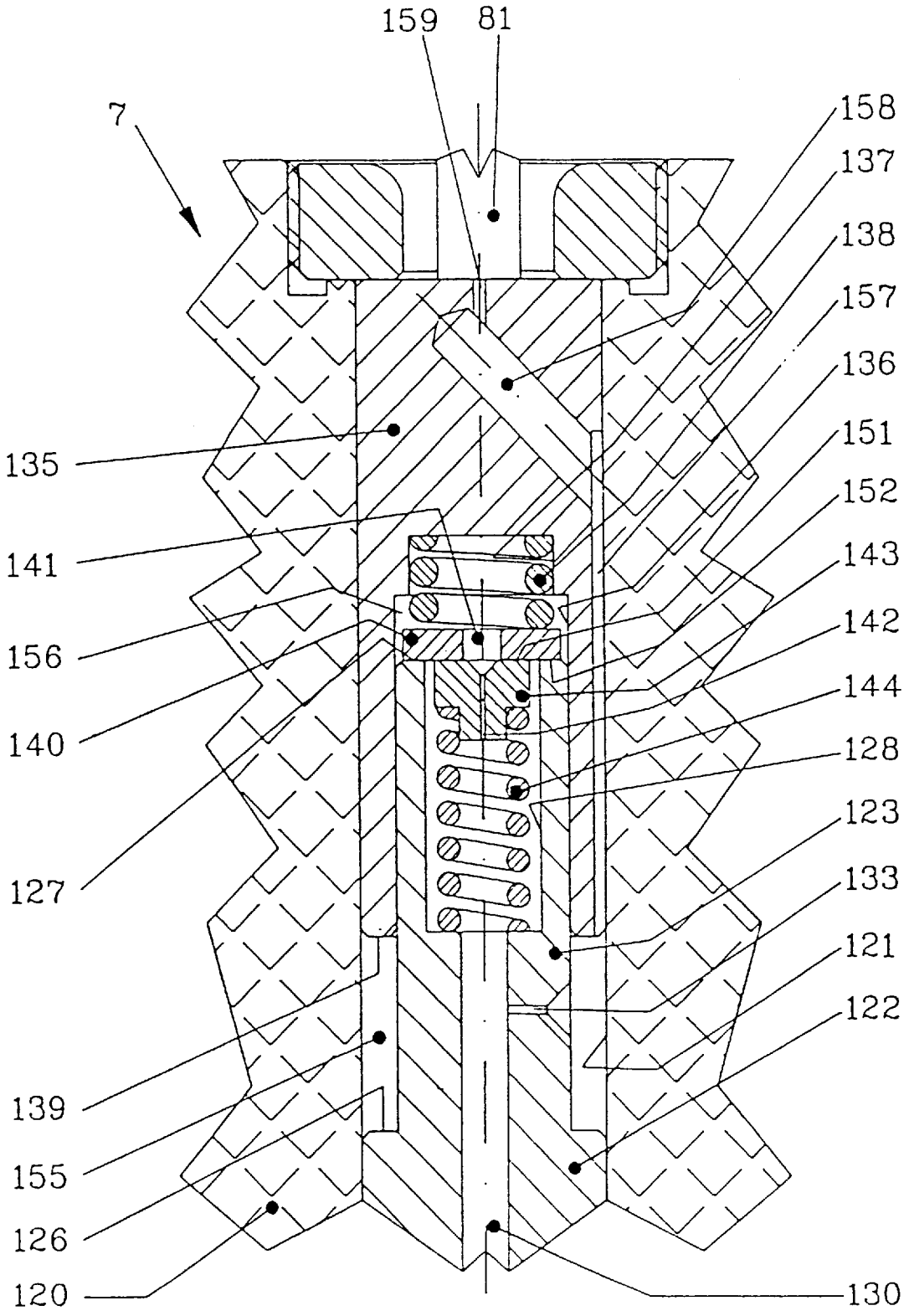
FIG. 7 shows, to an enlarged scale, a part of the control appliance shown in FIG. 6.

If, in the control appliance 7 of FIGS. 6 and 7, the valve body 143 with the throttle hole 142 and the spring 144 should be omitted and if the valve seat disc 140 should be directly provided with a disc hole 141 configured as a throttle, the mode of operation of the control appliance 7 would correspond to that of the control appliance 3 of FIG. 2. The disc hole 141 configured as a throttle would then correspond to the throttle 77, of FIG. 2, which connects the second control space 156 (the control space 74 in FIG. 2) to the high-pressure zone.

If the valve seat disc 140 and the spring 138 were also omitted, the control appliance 7 would correspond to the second alternative variant of the control appliance 3 of FIG. 2 (with a throttle 77 which is larger or is omitted altogether) because, in this case, the second control space 156 would also be directly connected to the high-pressure zone.

Figure 8:
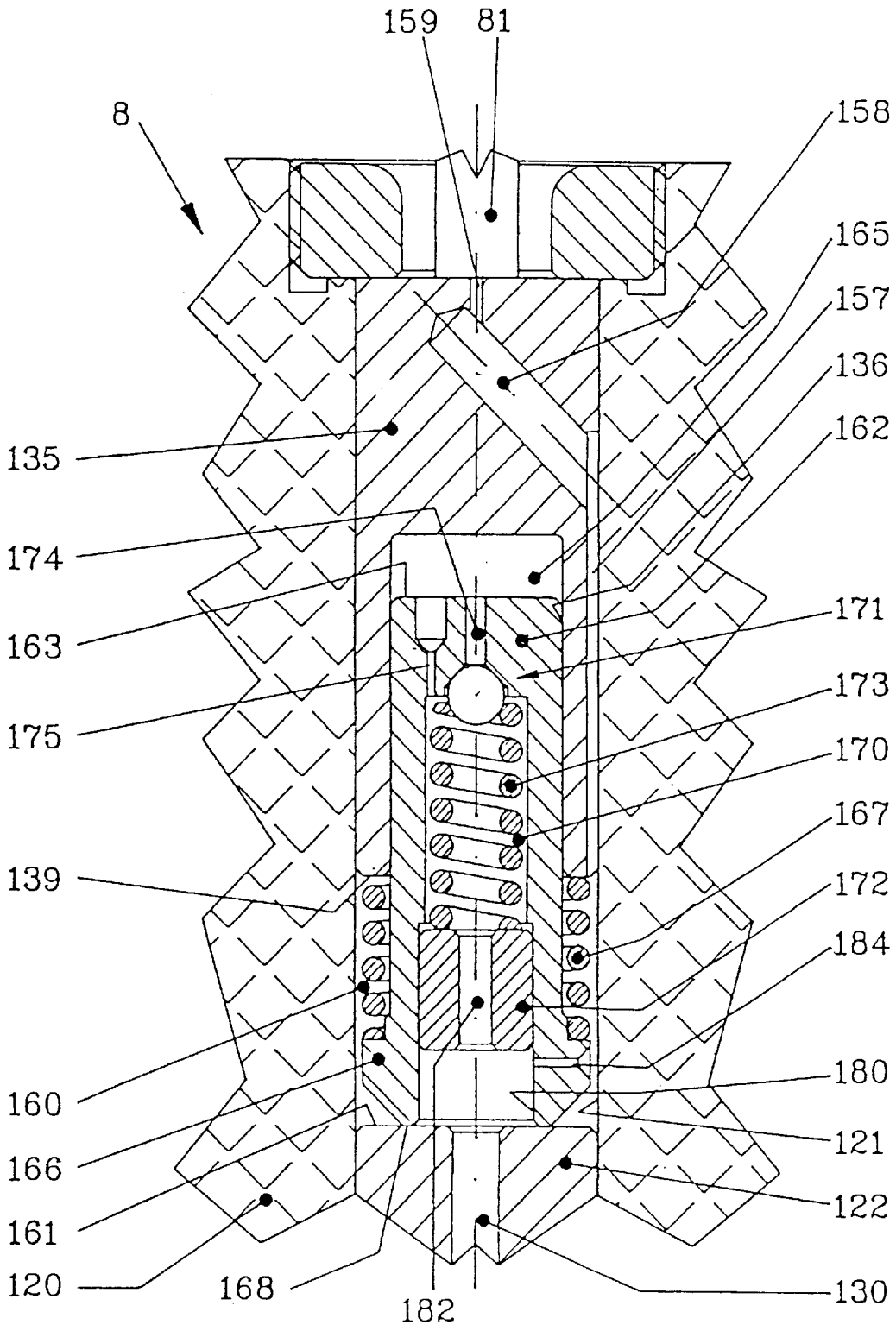
FIG. 8 shows a sixth embodiment of the control appliance for the fuel injection valve of FIG. 6.

FIG. 8 represents a further alternative embodiment of a control appliance 8 which can be used for the fuel injection valve 2. The parts known from FIGS. 6 and 7 are again designated by the same reference numbers.

The control piston 122 which is displaceably arranged in the guide hole 121 of the housing 120 does not, in this case, have a reduced diameter piston part but is terminated by an upper end surface 161. An intermediate piston 162, which protrudes into the recess 136 of the control body 135 with a close sliding fit, is arranged between the control piston 122 and the control body 135. A first annular control space 160 is radially bounded by the intermediate piston 162 and the guide hole 121 and is axially bounded by the upper end surface 161 of the control piston 122 and the lower end surface 139 of the control body 135. A second control space 165 is located above the intermediate piston 162, or above an upper end surface 163 of the intermediate piston 162, in the recess 136.

The intermediate piston 162 is provided with a shoulder 166. A spring 167 surrounding the intermediate piston 162 is supported on the shoulder 166, at one end, and on the lower end surface 139 of the control body 135, at the other end. At the bottom, the intermediate piston 162 has a narrow, annular sealing surface 168 which is associated with the upper end surface 161 of the control piston 122. The diameter of the sealing surface 168 is smaller than the diameter of the recess 136 and smaller than the diameter of the upper end surface 163 of the intermediate piston 162.

The intermediate piston 162 is provided, from underneath, with a central recess 170. A connecting hole 174 is manufactured in the intermediate piston between the recess 170 and the second control space 165 and a ball valve 171 arranged in the recess is associated with the connecting hole 174. A valve spring 173 is preloaded in the recess 170 by means of a locking element 172 which is pressed or screwed into a hole 180 in the intermediate piston 162. The locking element 172 has a central connecting hole 182 by means of which the space of the recess 170 is in connection with the connecting hole 130 arranged centrally in the control piston 122 and is, therefore, in connection with the high-pressure fuel zone. The intermediate piston 162 is additionally provided with a throttle hole 175 by means of which the second control space 165 is connected, in parallel with the connecting hole 174 which can be closed by means of the ball valve 171, to the recess 170 and therefore, to the high-pressure fuel zone.

The intermediate piston 162 has an inlet throttle 184 which connects the first control space 160 to the hole 180 and, therefore, to the high-pressure fuel zone.

Instead of the inlet throttle 184, it would be quite possible to provide the sealing surface 168 of the intermediate piston 162 with a plurality of radial depressions distributed around the periphery—in a similar manner to the case involving the sleeve 94 of FIG. 3 (see depressions 97)—in order to produce an inlet throttle connection between the first control space 160 and the high-pressure fuel zone.

The construction described results in the following mode of operation of the control appliance 8:

When the pilot valve stem 81 is lifted, the pressure in the first control space 160 is lowered by means of the outlet opening 159, the transverse hole 158 and the connecting groove 157. The control piston 122 is moved upward in the manner already described and the injection valve element frees the injection openings to the combustion space of the internal combustion engine. The intermediate piston 162, which is pressed by means of the sealing surface 168 onto the end surface 161, is also moved upward. The pressure in the second control space 165 rises due to the pumping effect of the intermediate piston 162. At a certain excess pressure, the ball valve 171 opens; the opening motion of the control piston 122 is accelerated by this means.

If the outlet opening 159 is closed again by the pilot valve stem 81, the pressure rises in the first control space 160. The pressure in the second control space 165 is brought into balance with the high pressure of the system. The ball valve 171 closes. With the increasing pressure in the first control space 160, the control piston 122, and also the intermediate piston 162, are moved downward. The volume of the second control space 165 becomes greater and the pressure drops. At a certain pressure drop, the contact pressure force of the intermediate piston 162 on the end surface 161 of the control piston 122 is no longer ensured. The intermediate piston 162, or its sealing surface 168, separates from the control piston 122 and the control piston 122 is additionally accelerated downward by the high fuel pressure (delivered by means of the connecting hole 130) acting on its end surface 161. The injection valve element is abruptly closed. In contrast to the control appliance known from FIG. 7, the whole of the piston surface is acted on in the present case—in a manner similar to that for the control appliance 3 in FIG. 2.

The control appliance 8 signifies a substantial design simplification. As is known, exact concentricity, i.e. accurate machining, is important in the case of the close fits between individual parts. In this embodiment, none of the parts exhibits two such mutually matched sliding surfaces. The control piston 122 has an extremely simple form in this case. The assembly of individual parts of the control appliance 8 in the fuel injection valve 2 involves no problems. Furthermore, the essential functional control elements (the throttle holes 175 and 184 and the ball valve 171) are manufactured or are installed in the intermediate piston 162. These throttle holes 175 and 184 and the ball valve 171 can be tested for correct function before assembly of the fuel injection valve 2.

If the ball valve 171 and the valve spring 173 were to be omitted in this control appliance 8, the appliance would correspond to the control appliance 2 known from FIG. 2; here again, the second control space 165 would then only be connected to the high-pressure zone by means of the throttle 175 (corresponding to the throttle 77 of FIG. 2).

The control appliance 8 could also, however, be configured to correspond with the second alternative variant described of the control appliance 2 (not represented in the drawing) by connecting the second control space 165 directly to the high-pressure zone by means of a large passage hole in the intermediate position 162 rather than by means of the throttle 175, which would be omitted together with the locking element 172, the ball valve 171 and the valve spring 173.

Figure 9:
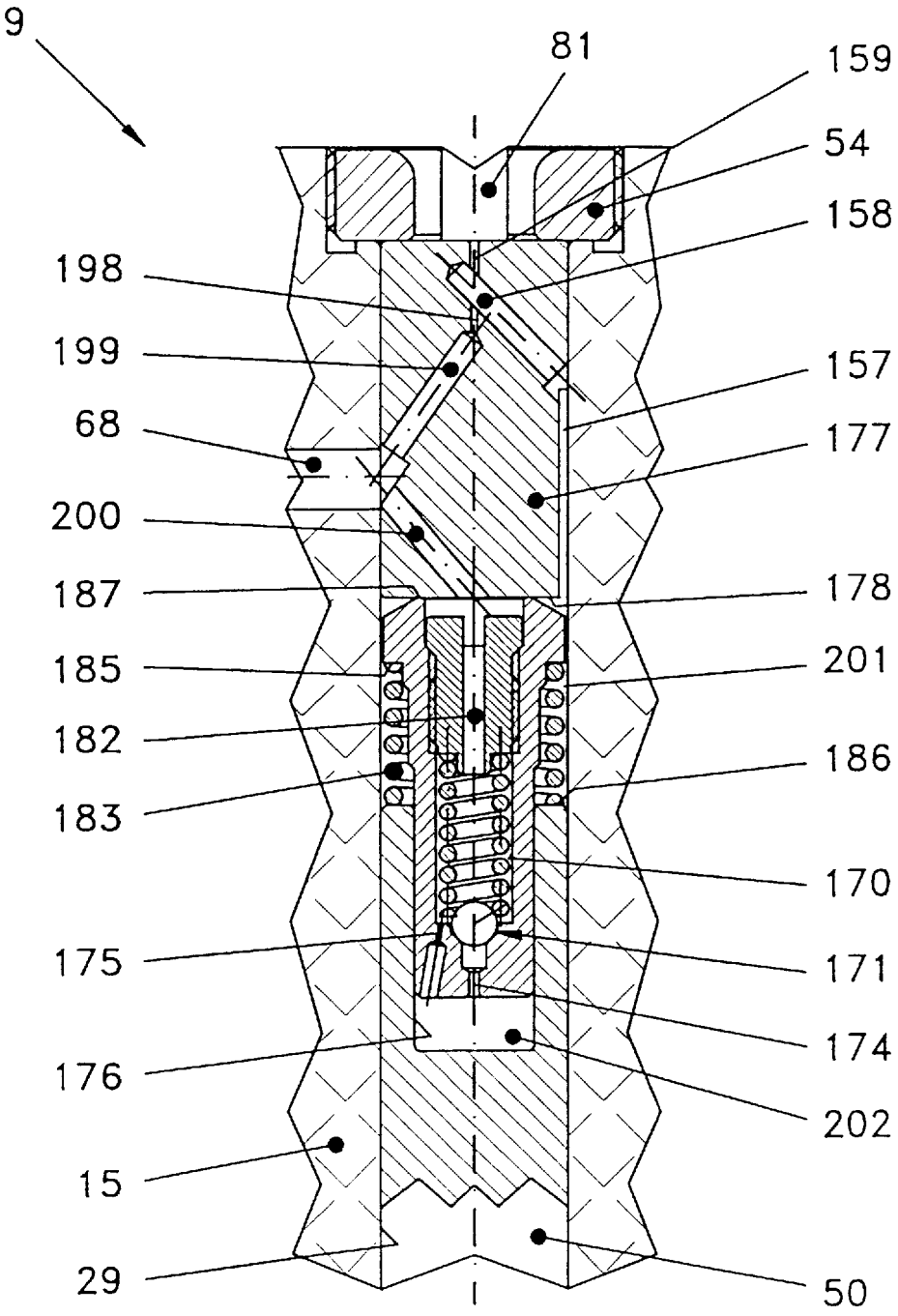
FIG. 9 shows a seventh embodiment of the control appliance for the fuel injection valve of FIG. 1.

A further embodiment of a control appliance 9 is represented in FIG. 9. The design and function of this control appliance 9 corresponds essentially to the control appliance 8 of FIG. 8 but is, for example, suitable for the fuel injection valve 1 of FIG. 1 in which, in contrast to the fuel injection valve 2 of FIG. 6, the high-pressure fuel supply to the control appliance takes place from above. In a manner analogous to the control appliance 8, the control appliance 9 also exhibits the manufacturing and assembly advantages mentioned above.

In this variant, a control body 177 provided with a lower end surface 178 is arranged in a fixed position in the guide hole 29 of the valve housing 15. The control piston 50, which can be axially displaced in the guide hole 29, is provided at the top with a central recess 176. An intermediate piston 179, which is supported on the end surface 178 of the control body 177 by means of a narrow, annular sealing surface 187, protrudes with a close sliding fit into the recess 176 of the control piston 50. The intermediate piston 179 corresponds essentially to the intermediate piston 162 of FIG. 8 but, relative to the latter, has an arrangement which is rotated vertically by 180°. Because the internal design of the intermediate piston 179 corresponds to that of the intermediate piston 162, the parts acting in the same manner are designated by the same reference numbers (see recess 170, ball valve 171, locking element 172, connecting holes 174 and 182, throttle 175 and valve spring 170). A spring 183 surrounding the intermediate piston 179 is supported, at one end, on a shoulder 185 of the intermediate piston 179 and, at the other end, on an upper end surface 186 of the control piston 50. A first, annular control space 201 is radially bounded by the intermediate piston 179 and the guide hole 29 and is axially bounded by the upper end surface 186 of the control piston 50 and the lower end surface 178 of the control body 177. The first control space 201 is connected, in a manner analogous to the control appliances 7 and 8 of FIGS. 7 and 8, by means of the at least one connecting groove 157 manufactured on the periphery of the control body 177 and by means of the transverse hole 158 to the outlet opening 159 which can be closed by the pilot valve stem 81. The transverse hole 158 is connected to the transverse hole 68 leading to the upper high-pressure supply conduit 33 (see FIG. 1) by means of a throttle 198 and by means of a passage 199.

A second control space 202 is formed in the recess 176 of the control piston 50, below the intermediate piston 179. The second control space 202 is, at times, in connection with the transverse hole 68, which is connected to the high-pressure zone, by means of the connecting hole 174 which can be closed by the ball valve 171 and is continually in connection with the said transverse hole 68 by means of the throttle 175 and by means of the connecting hole 182 in the locking element 172 and by means of a passage 200 manufactured in the control body 177.

The mode of operation of the control appliance 9 corresponds to the mode of operation described for the control appliance 8 of FIG. 8 and is not therefore repeated. This control appliance 9 also could be alternatively configured, in a manner analogous to the control appliance 8, by omitting individual parts in order to correspond to the control appliance 2 of FIG. 2 and to the second alternative variant which has been described for this control appliance 2.

Figure 10:
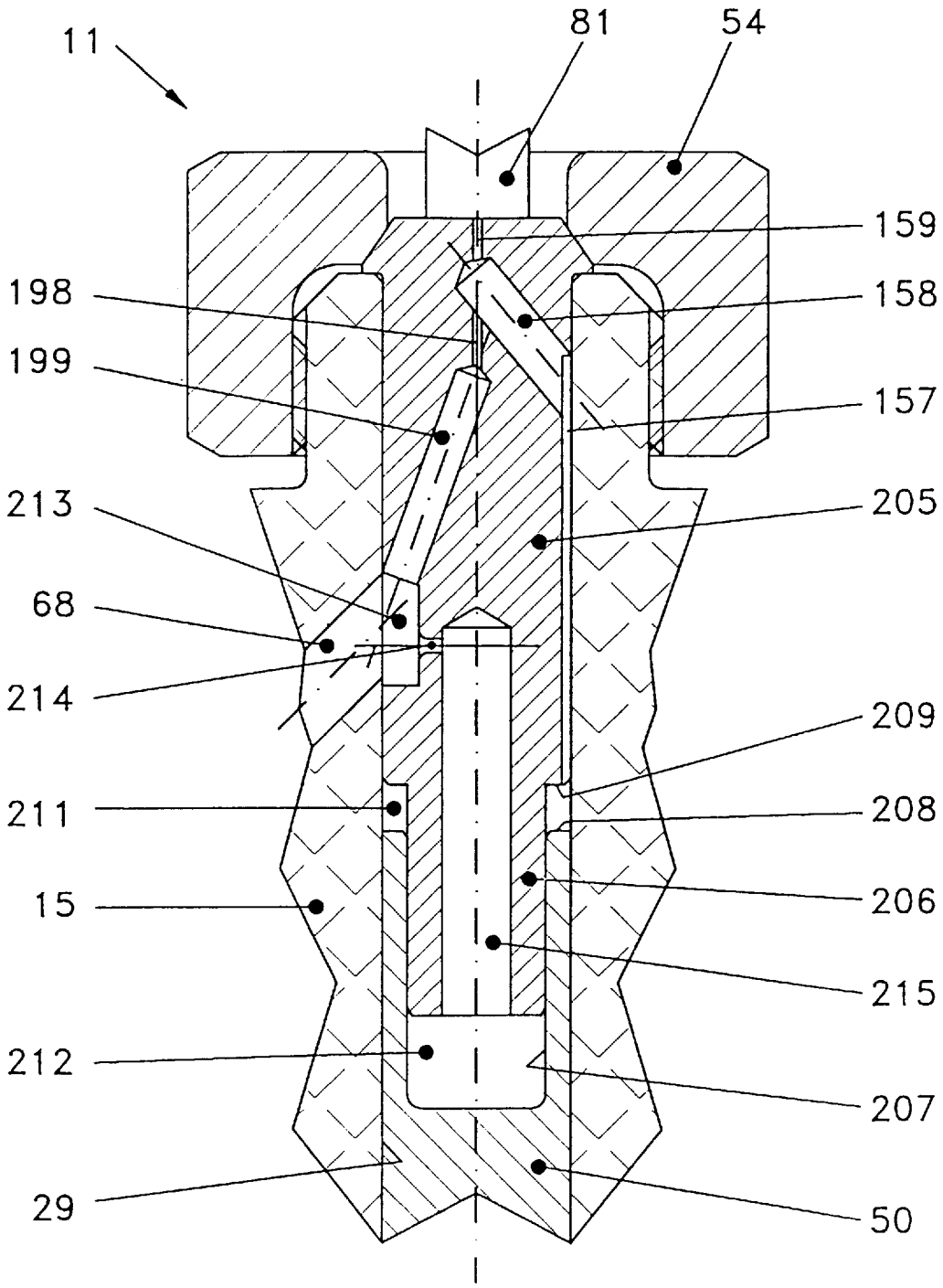
FIG. 10 shows an eighth embodiment of the control appliance for the fuel injection valve of FIG. 1.

A further embodiment of a control appliance 11 provided for the fuel injection valve 1 of FIG. 1 is represented in FIG. 10. This design is particularly suitable for small fuel injection valves in which no space is available for arranging valves and springs.

A control body 205 is inserted at a fixed location (by pressing it in, for example) in the central guide hole 29 of the valve housing 15 and is axially fixed by the lock nut 54 which is here configured as a union nut. At the bottom, the control body 205 has a reduced diameter part 206 by means of which it protrudes into a central recess 207 of the control piston 50 which can be axially displaced in the guide hole 29. A first, annular control space 211 is bounded radially by the part 206 of the control body 205 and by the guide hole 29 and is bounded axially by a shoulder surface 209 of the control body 205 and an upper end surface 208 of the control piston 50. In a similar manner to that of the control appliances 7, 8 and 9, the first control space 211 is again connected to the outlet opening 159, which can be closed by the pilot valve stem 81, by means of at least one connecting groove 157 manufactured on the periphery of the control body 205 and by means of the transverse hole 158. In a manner similar to that of the control appliance 9, the transverse hole 158 is connected to the transverse hole 68 leading to the upper high-pressure supply conduit 33 (see FIG. 1) by means of the throttle 198 and by means of the passage 199. In this case, the transverse hole 68 is obliquely arranged and is associated with a radial recess 213 of the control body 205. The recess 213 is connected, by means of a throttle 214 and a central hole 215 in the control body 205, to a second control space 212 which is located below the control body 205 in the central recess 207 of the control piston 50.

In this embodiment, the opening procedure takes place in one step in a manner similar to that in the case of the control appliance 2 of FIG. 2; the throttle 214 corresponds, in this case, to the throttle 77 of FIG. 2. In this variant, however, no additional acceleration, such as was the case with the control appliance 2, takes place during the closing procedure. The control appliance 11 is simple with respect to manufacture and assembly and, as already mentioned, is mainly suitable for small fuel injection valves.

Figure 11:
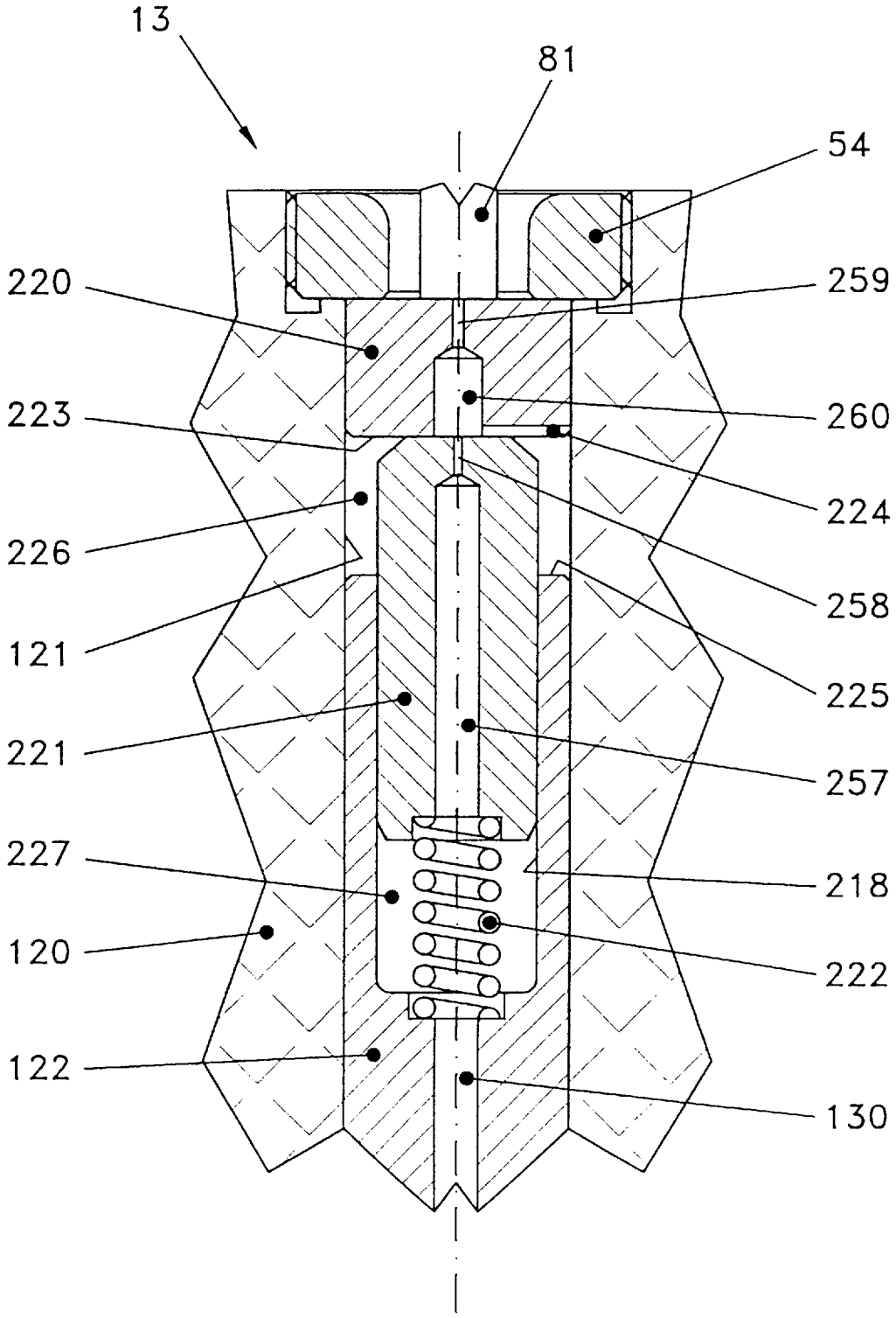
FIG. 11 shows a ninth embodiment of the control appliance for the fuel injection valve of FIG. 6.

FIG. 11 shows a further embodiment of a control appliance 13 which can be employed for the fuel injection valve 2 of FIG. 6. The control piston 122, which is provided with the central connecting hole 130 connected to the high-pressure zone and which can be axially displaced in the guide hole 121 of the valve housing 120, has a central recess 218 at the top. A first control body part 220 is arranged in a fixed location (pressed in, for example) in the guide hole 121 and is axially fixed by the lock nut 54. A second control body part 221 protrudes into the recess 218 and its top is pressed, by a spring 222 arranged in the recess 218, onto a lower end surface 223 of the first control body part 220.

The first control body part 220 is provided with a hole 260 which narrows into an outlet opening 259, which can be closed by the pilot valve stem 81 and which is connected to a first control space 226 by means of at least one radial groove 224 manufactured in the lower end surface 223. The groove 224 could also be configured in the end surface of the second control body part 221. The first, annular control space 226 is bounded radially by the guide hole 121 and the second control body part 221 and is bounded axially by the lower end surface 223 of the first control body part 220 and an upper end surface 225 of the control piston 122. A second control space 227, which is directly connected to the high-pressure zone by means of the connecting hole 130, is located in the recess 218 below the second control body part 221. The second control body part 221 is provided with a central hole 257 which narrows at the top into an inlet throttle hole 258. The first control space 226 is connected to the high-pressure zone by means of the inlet throttle hole 258, in a manner similar to the connection by means of the inlet throttle hole 58 of FIG. 2. The spring 222 can possibly be omitted because the high system pressure present in the second control space 227 ensures that the second control body part 221 is continually pressed onto the first control body part 220.

In its mode of operation, the control appliance 13 corresponds to the second alternative variant of the control appliance 2 of FIG. 2, which variant has been mentioned but is not represented in the drawing. In the present variant also, the high system fuel pressure, which remains practically unaffected due to the pumping effect of the control piston 122, is continually present in the second control space 227. The opening and closing motions of the control piston 122, and therefore of the nozzle needle 24 also, are controlled by the control pressure present in the first control space 226, by means of the annular upper end surface 225 of the control piston 122, this control pressure being dependent on the design and spatial arrangement of the inlet throttle hole 258 and the outlet opening 259.

The division of a single control body into two control body parts 220 and 221 introduces particularly simple manufacture and assembly of the control appliance 13.

Figure 12:
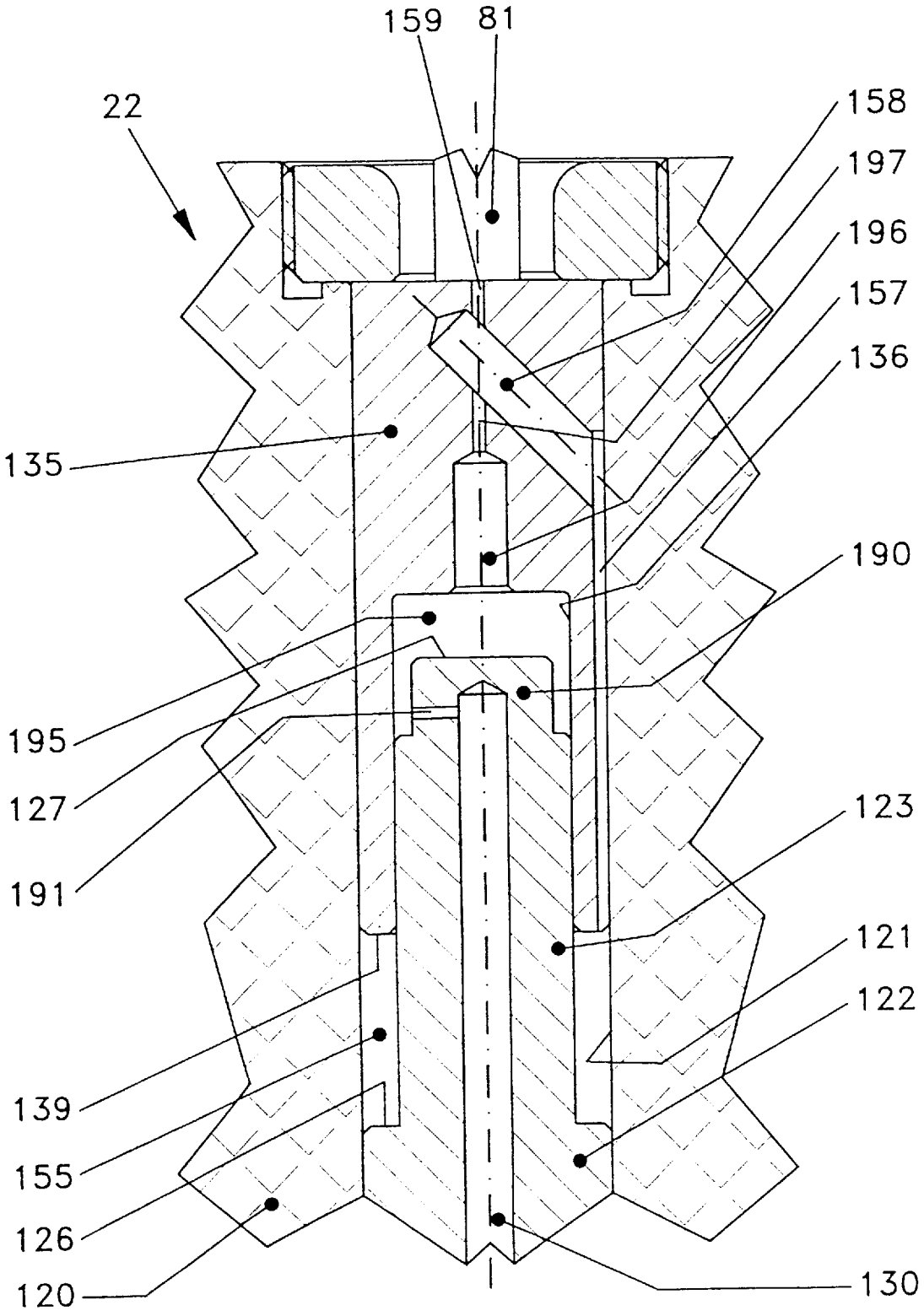
FIG. 12 shows a tenth embodiment of the control appliance for the fuel injection valve of FIG. 6.

A further embodiment of a control appliance 22 for the fuel injection valve 2 of FIG. 6 is represented in FIG. 12 and is described below. The same reference numbers are again used for the parts which are already known.

In a manner similar to the control appliance 11 of FIG. 10, this design is particularly suitable for small fuel injection valves in which there is no space available for arranging valves and springs.

In a manner similar to that of the control appliance 7 of FIGS. 6 and 7, the first control space 155 of the control appliance 22 is radially bounded by the guide hole 121 and the reduced diameter piston part 123 and is axially bounded by a piston shoulder 126 and the lower end surface 139 of the control body 135. The piston part 123 is provided with an additionally reduced part 190 in this case. A second control space 195 is formed above the piston part 123 in the recess 136 of the control body 135. A throttle 191 manufactured in the radial direction in the reduced part 190 connects the second control space 195 to the connecting hole 130 and therefore to the high fuel pressure zone. The throttle 191 could also be manufactured on the longitudinal axis of the control piston 122 or of the fuel injection valve 2 (in a manner similar to the throttle holes 197 and 159). A central hole 196, which opens into the second control space 195 and is connected to the transverse hole 158 by means of a throttle 197, is present in the control body 135. In contrast to the control appliance 7 of FIG. 7, the first control space 155 is not connected to the high-pressure system in this case (see throttle hole 133 in FIG. 7) but receives pressure from the second control space 195 by means of the throttle 197, the transverse hole 158 and the connecting groove 157. During both the opening and the closing procedures, the pressure in the two control spaces 155 and 195 and the pumping effect of the control piston 122 depends on the design of the throttles 191 and 197. The throttle 191 replaces the first valve flat seating 151 and the throttle hole 142 of FIG. 7. In this design, no additional acceleration takes place during the closing procedure. The design is extremely simple, as is its assembly.

Although the present invention has been described and illustrated in detail, it should be clearly understood that the same is by way of illustration and example only and is not to be taken by way of limitation, the spirit and scope of the present invention being limited only by the terms of the appended claims.

I claim:

1. A fuel injection valve for intermittent injection of fuel into a combustion space of an internal combustion engine, comprising:

a housing;

a valve seat element provided with injection orifices;

an injection valve member guided so as to be longitudinally displaceable in the housing in respective closing and opening directions for closing and opening the injection orifices, the injection valve member being subjected in the opening direction to a fuel pressure from a high-pressure fuel supply conduit;

a control device for controlling the movement of the injection valve member, the control device having a control piston which is guided so as to be longitudinally displaceable, the control piston being subjected on a first side to a fuel control pressure in a control space within the control device and which is connected to the high-pressure fuel supply conduit via at least one inlet orifice;

an electrically actuable pilot valve for opening and closing at least one outlet orifice opening into the control space for the purpose of controlling the control pressure in the control space;

an intermediate element which is guided so as to be longitudinally displaceable and via which the control piston is operatively connected to the injection valve member on a second side located opposite the first side; and a spring element which is supported at a first end fixedly relative to the housing, the spring having a second end acting on a side of the intermediate element facing away from the injection valve member.

2. The fuel injection valve according to claim 1, wherein:

the intermediate element and the injection valve member are separate parts.

3. The fuel injection valve according to claim 1, wherein:

the intermediate element is guided in a guide bore provided therefor in the housing.

4. The fuel injection valve according to claim 1, wherein:

the spring element is supported at its first end on a spring tensioning disk which is of a given thickness and is supported fixedly relative to the housing.

5. The fuel injection valve according to claim 4, wherein:

the spring tensioning disk bears o n a shoulder of the housing, on a side of the housing facing away from the spring element.

6. The fuel injection valve according to claim 1, wherein:

a connecting rod arranged between the intermediate element and the control piston and extending through the spring element.

* * * * *